US010515577B2

(12) United States Patent
Kim et al.

(10) Patent No.: US 10,515,577 B2
(45) Date of Patent: Dec. 24, 2019

(54) DISPLAY DEVICE

(71) Applicant: LG Display Co., Ltd., Seoul (KR)

(72) Inventors: Jae-Kwang Kim, Goyang-si (KR); Daeseok Oh, Paju-si (KR); Jiyoung Jung, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 15/695,213

(22) Filed: Sep. 5, 2017

(65) Prior Publication Data

US 2018/0090049 A1 Mar. 29, 2018

(30) Foreign Application Priority Data

Sep. 29, 2016 (KR) ..... 10-2016-0125420

(51) Int. Cl.
*G09G 3/20* (2006.01)
*G09G 3/36* (2006.01)
*G09G 3/3233* (2016.01)

(52) U.S. Cl.
CPC ..... *G09G 3/2018* (2013.01); *G09G 3/3611* (2013.01); *G09G 3/3666* (2013.01); *G09G 3/3677* (2013.01); *G09G 3/3688* (2013.01); *G09G 3/3233* (2013.01); *G09G 3/3614* (2013.01); *G09G 2310/08* (2013.01); *G09G 2320/0252* (2013.01); *G09G 2320/0285* (2013.01); *G09G 2320/0673* (2013.01);
(Continued)

(58) Field of Classification Search
CPC .. G09G 3/2018; G09G 3/3611; G09G 3/3666; G09G 3/3688; G09G 3/3677; G09G 2320/0686; G09G 2320/0285; G09G 3/3614; G09G 2330/02; G09G 2310/08; G09G 3/3233; G09G 2320/0252; G09G 2340/16; G09G 2360/12; G09G 2320/0673
See application file for complete search history.

(56) References Cited

U.S. PATENT DOCUMENTS 9,329,725 B2 * 5/2016 Pyo ..... G06F 3/0412
2003/0117356 A1 * 6/2003 Moon ..... G02F 1/13452 345/87

(Continued)

FOREIGN PATENT DOCUMENTS

KR 10-1322002 B1 10/2013
KR 10-1385477 B1 4/2014

*Primary Examiner* — Jose R Soto Lopez
(74) *Attorney, Agent, or Firm* — Morgan, Lewis & Bockius LLP

(57) ABSTRACT

A display device includes an image signal processor generating modulation data of each pixel region corresponding to a display period of each frame based on an image signal and predetermined modulation value tables which are preset to different gains. The image signal processor includes a block divider and at least two data modulators. The block divider divides the display region into at least two block regions along a second direction. The at least two data modulators correspond to the at least two block regions, modulate gray scale data of each of pixel regions included in each block region based on a modulation value table, and generate modulation data of the pixel regions included in each block region. As a result, a difference in the charge amount caused by line resistance can be compensated according to the overdriving scheme, resulting in prevention of image quality deterioration.

9 Claims, 10 Drawing Sheets

(52) U.S. Cl.
CPC . *G09G 2320/0686* (2013.01); *G09G 2330/02* (2013.01); *G09G 2340/16* (2013.01); *G09G 2360/12* (2013.01)

(56) References Cited

U.S. PATENT DOCUMENTS

2004/0145552 A1* 7/2004 Song ..... G02F 1/13452 345/87
2005/0083474 A1* 4/2005 Park ..... G02F 1/13452 349/151
2007/0002005 A1* 1/2007 Kim ..... G09G 3/3655 345/103
2007/0247408 A1* 10/2007 Nishimura ..... G09G 3/3688 345/89
2007/0290964 A1* 12/2007 Yang ..... G09G 3/3648 345/87
2008/0218496 A1* 9/2008 Song ..... G09G 3/3688 345/204
2008/0239184 A1* 10/2008 Kim ..... G09G 3/3696 349/41
2009/0002406 A1* 1/2009 Yokota ..... G09G 3/3688 345/690
2009/0225072 A1* 9/2009 Mizukoshi ..... G09G 3/3233 345/214
2010/0026732 A1* 2/2010 Otawara ..... G09G 3/2007 345/690
2010/0053059 A1 3/2010 Kim et al.
2010/0053185 A1* 3/2010 Hwang ..... G09G 3/2055 345/556
2010/0127960 A1* 5/2010 Jung ..... G09G 3/3688 345/89
2010/0171774 A1* 7/2010 Mizukoshi ..... G09G 3/3275 345/690
2010/0201674 A1* 8/2010 Kim ..... G09G 3/3233 345/211
2011/0128302 A1* 6/2011 Cho ..... G09G 3/3426 345/690
2012/0212474 A1* 8/2012 Hwang ..... G09G 3/3648 345/212
2012/0249514 A1* 10/2012 Ahn ..... G09G 3/3233 345/212
2013/0141401 A1* 6/2013 Kang ..... G09G 3/3688 345/204
2013/0314392 A1* 11/2013 Kim ..... G09G 3/20 345/212
2014/0062989 A1* 3/2014 Ebisuno ..... G09G 3/3241 345/212
2014/0071112 A1* 3/2014 Han ..... G06F 3/038 345/212
2015/0022512 A1* 1/2015 Ahn ..... G09G 3/3607 345/212
2015/0033047 A1* 1/2015 Byun ..... G06F 1/3206 713/320
2015/0035818 A1* 2/2015 Shin ..... G09G 3/3648 345/212
2015/0097871 A1* 4/2015 Kumeta ..... G09G 3/2003 345/690
2015/0154912 A1* 6/2015 Hong ..... G09G 3/3225 345/211
2015/0187294 A1* 7/2015 Chen ..... G09G 3/3685 345/205
2016/0148578 A1* 5/2016 Kishi ..... G09G 3/3233 345/212
2016/0240140 A1* 8/2016 Park ..... G09G 3/3208
2016/0307543 A1* 10/2016 Lim ..... G09G 3/20
2016/0365042 A1* 12/2016 Zheng ..... G09G 3/36
2017/0186395 A1* 6/2017 Jeon ..... G09G 3/3688
2017/0301304 A1* 10/2017 Gao ..... G09G 3/3648
2018/0033381 A1* 2/2018 Hwang ..... G09G 3/3607
2018/0144690 A1* 5/2018 Inokawa ..... G09G 3/32

* cited by examiner

DISPLAY DEVICE

CROSS-REFERENCE TO RELATED APPLICATION

This application claims the benefit of Korean Patent Application No. 10-2016-0125420, filed on Sep. 29, 2016 in the Korean Intellectual Property Office, the disclosure of which is incorporated herein by reference.

BACKGROUND

1. Technical Field

The present disclosure relates to a display device.

2. Description of the Related Art

A display device has been formed as a flat panel display, and has been applied to various electronic devices, for example, TVs, mobile phones, laptops, tablets, etc.

There are various examples of the display device, for example, a Liquid Crystal Display (LCD) device, a Plasma Display Panel (PDP) device, a Field Emission Display (FED) device, an Electro Luminescent Display (ELD) device, an Electro-wetting Display (EWD) device, an Organic Light Emitting Display (OLED) device, and the like.

Generally, the display device includes one pair of substrates bonded to each other while facing each other; a polarization or luminous material disposed between the one pair of substrates; and a thin film transistor (TFT) array. The thin film transistor array divides a display region for displaying images into a plurality of pixel regions corresponding to a plurality of pixels so and controls brightness of the respective pixels.

The TFT array may include a gate line and a data line to cross each other in the display region, and a plurality of thin film transistors (TFTs) corresponding to a plurality of pixels. Each TFT may be connected to a pixel electrode and a storage capacitor.

Accordingly, if a data signal of the data line is supplied through a TFT on the condition that the TFT is turned on by a gate signal of the gate line, a pixel electrode and a storage capacitor may be charged based on the data signal. In this case, light having brightness corresponding to the amount of voltage (hereinafter referred to as the charge amount) charged in each pixel may be emitted from each pixel region.

However, by the respective line resistors of the gate line and the data line, a waveform of a signal applied to each pixel is modified, such that brightness displayed in the pixel region of some pixels may not correspond to the signal. Especially, if a waveform of the data signal corresponding to brightness of each pixel is modified, the charge amount is reduced, resulting in reduction in image quality.

With the increasing demand of consumers or users who use such display devices, display devices have been rapidly developed to implement larger-sized and higher-definition products, such that a method for preventing image deterioration caused by the increasing line resistance needs to be developed.

Meanwhile, an integrated circuit (IC) of a data driver for driving the data line is more expensive than a gate driver. To reduce fabrication costs of the display device, a method for reducing the number of data lines instead of a method for increasing the number of gate lines has been proposed. In this case, TFTs of pixels arranged at two or more vertical lines are connected to each data line, such that line resistance of each data line is greatly increased.

In addition, a horizontal time is reduced in proportion to the increased number of gate lines. Accordingly, it is actually impossible to offset a difference in the charge amount caused by a modified waveform of the data signal caused by line resistance, using a horizontal period. Therefore, image quality deterioration caused by line resistance becomes more serious.

SUMMARY

Accordingly, the present disclosure is directed to a display apparatus that substantially obviates one or more problems due to limitations and disadvantages of the related art.

It is an object of the present disclosure to provide a display device preventing quality deterioration caused by line resistance.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described, a display device comprises an image signal processor generating modulation data of each pixel region corresponding to a display period of each frame to a timing controller based on an image signal and predetermined modulation value tables. The image signal processor may include a block divider and at least two data modulators. The block divider may divide a display region into at least two block regions along a second direction, and may sorting gray scale data of the plurality of pixel regions into a plurality of parts corresponding to the at least two block regions. The at least two data modulators may correspond to the at least two block regions. Each of at least two data modulators may modulate gray scale data of each of pixel regions included in each block region based on a predetermined modulation value table, and may thus generate modulation data of each of the pixel regions included in each block region. The predetermined modulation value tables of the at least two data modulators may be preset to different gains.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated and constitute a part of this application, illustrate embodiments of the disclosure and together with the description serve to explain various principles. In the drawings.

DETAILED DESCRIPTION

Figure 1:
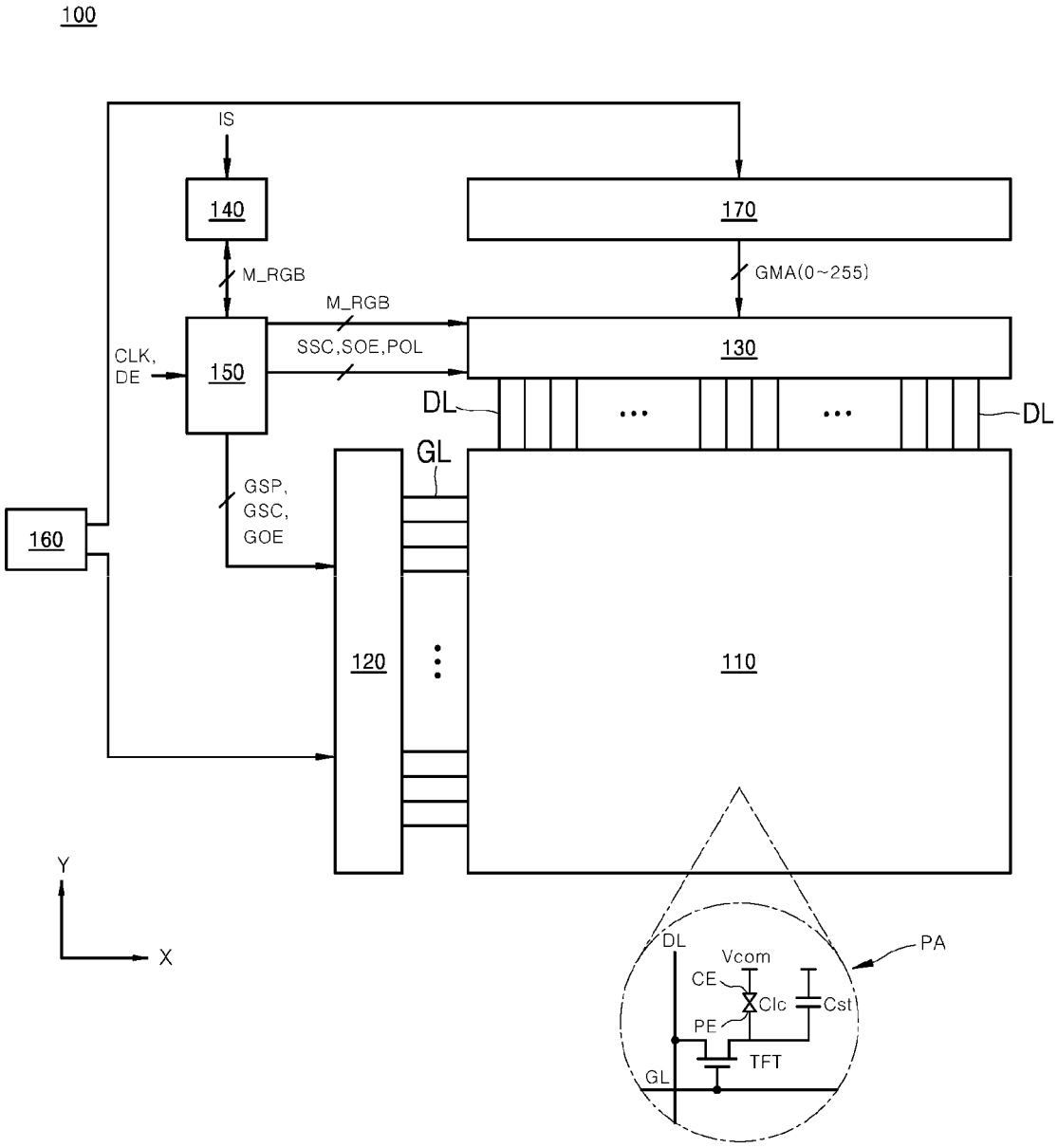
FIG. 1 is a block diagram illustrating a display device according to a first embodiment of the present disclosure.

Reference will now be made in detail to the embodiments of the present disclosure, examples of which are illustrated in the accompanying drawings, wherein like reference numerals refer to like elements throughout. A display device according to embodiments of the present disclosure will hereinafter be described with reference to the attached drawings.

A display device according to a first embodiment of the present disclosure will hereinafter be described with reference to FIGS. 1 to 7.

Figure 2:
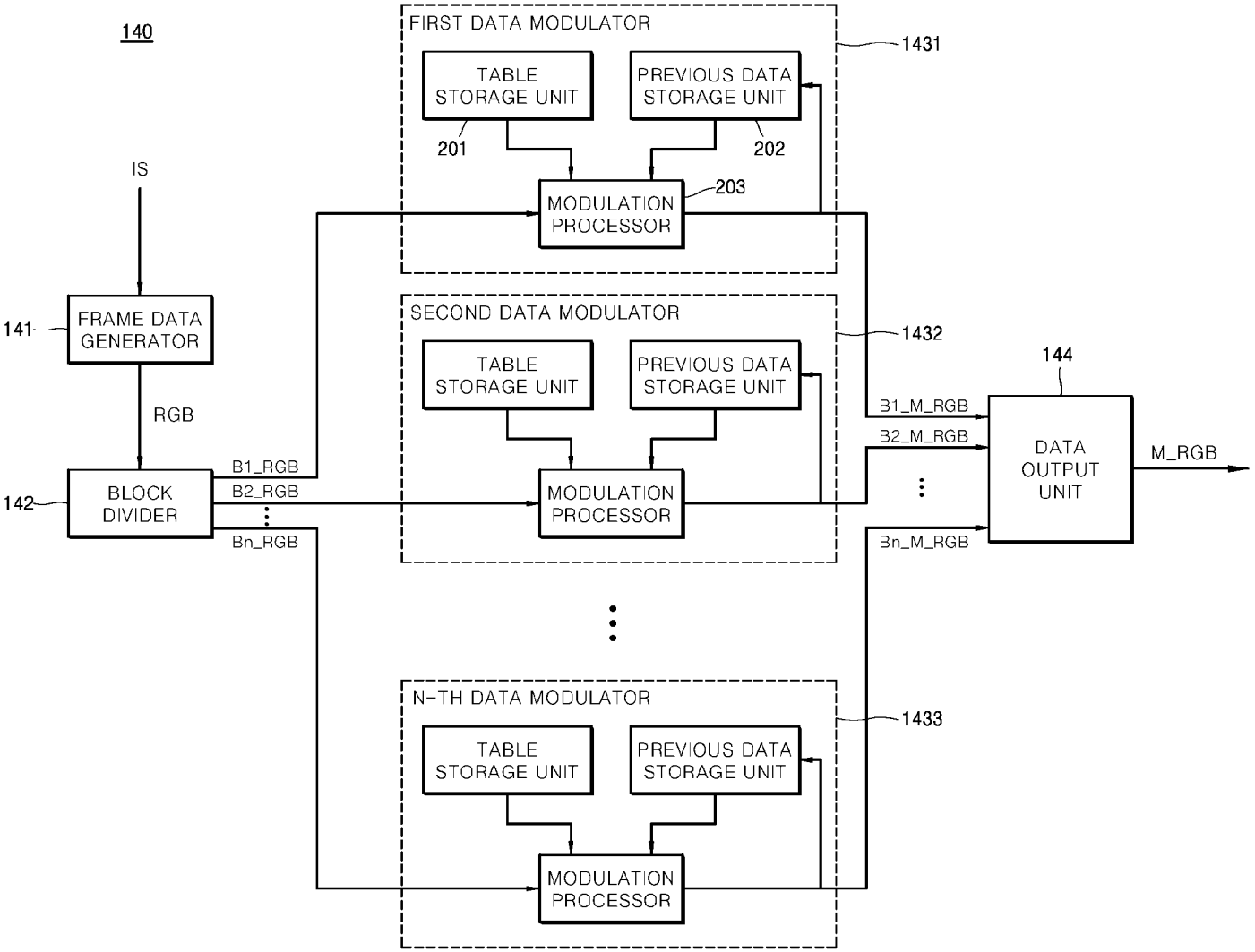
FIG. 2 is a block diagram illustrating an image signal processor shown in FIG. 1.
Figure 3:
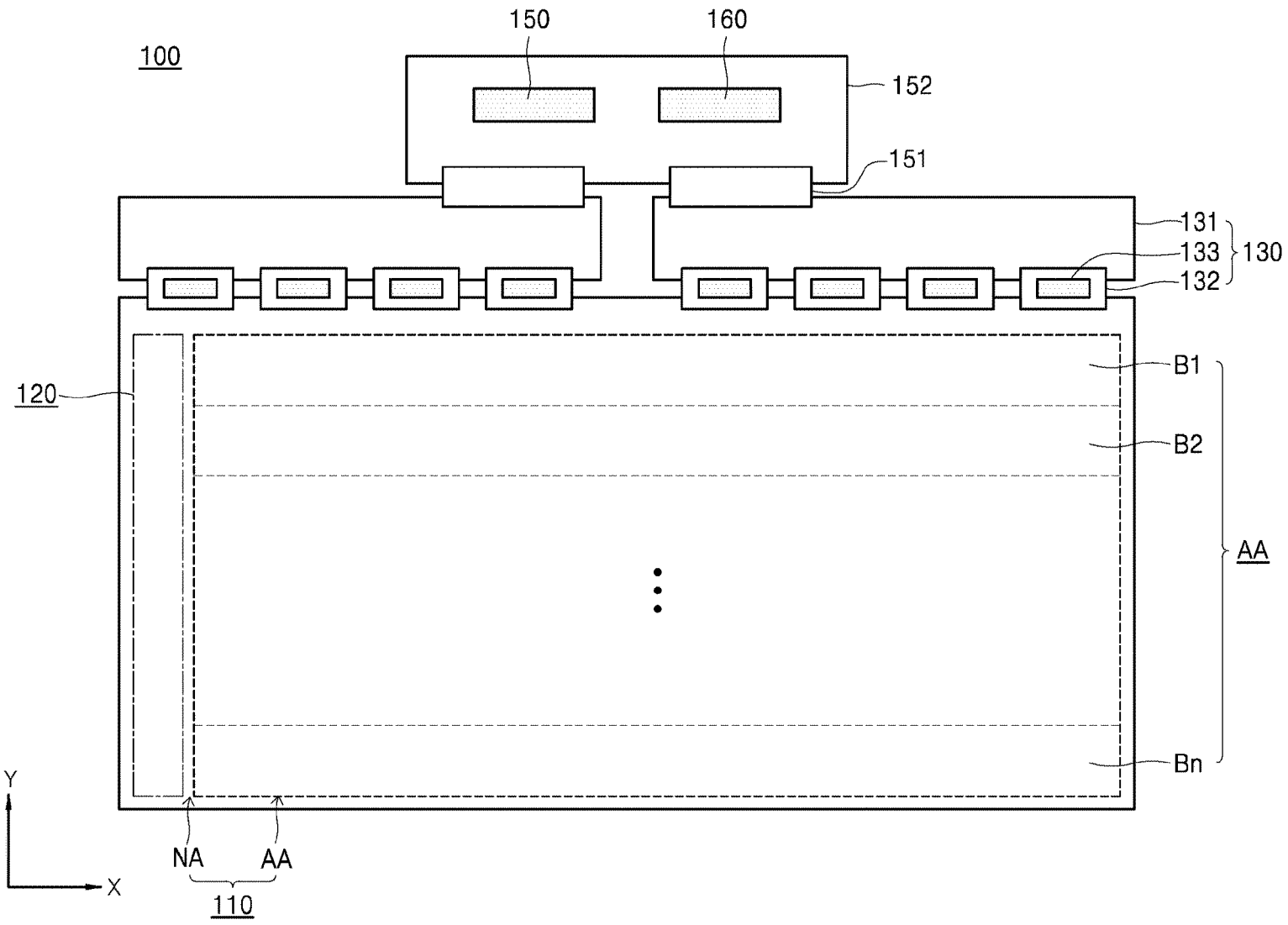
FIG. 3 is a plan view illustrating the display device shown in FIG. 1.
Figure 4:
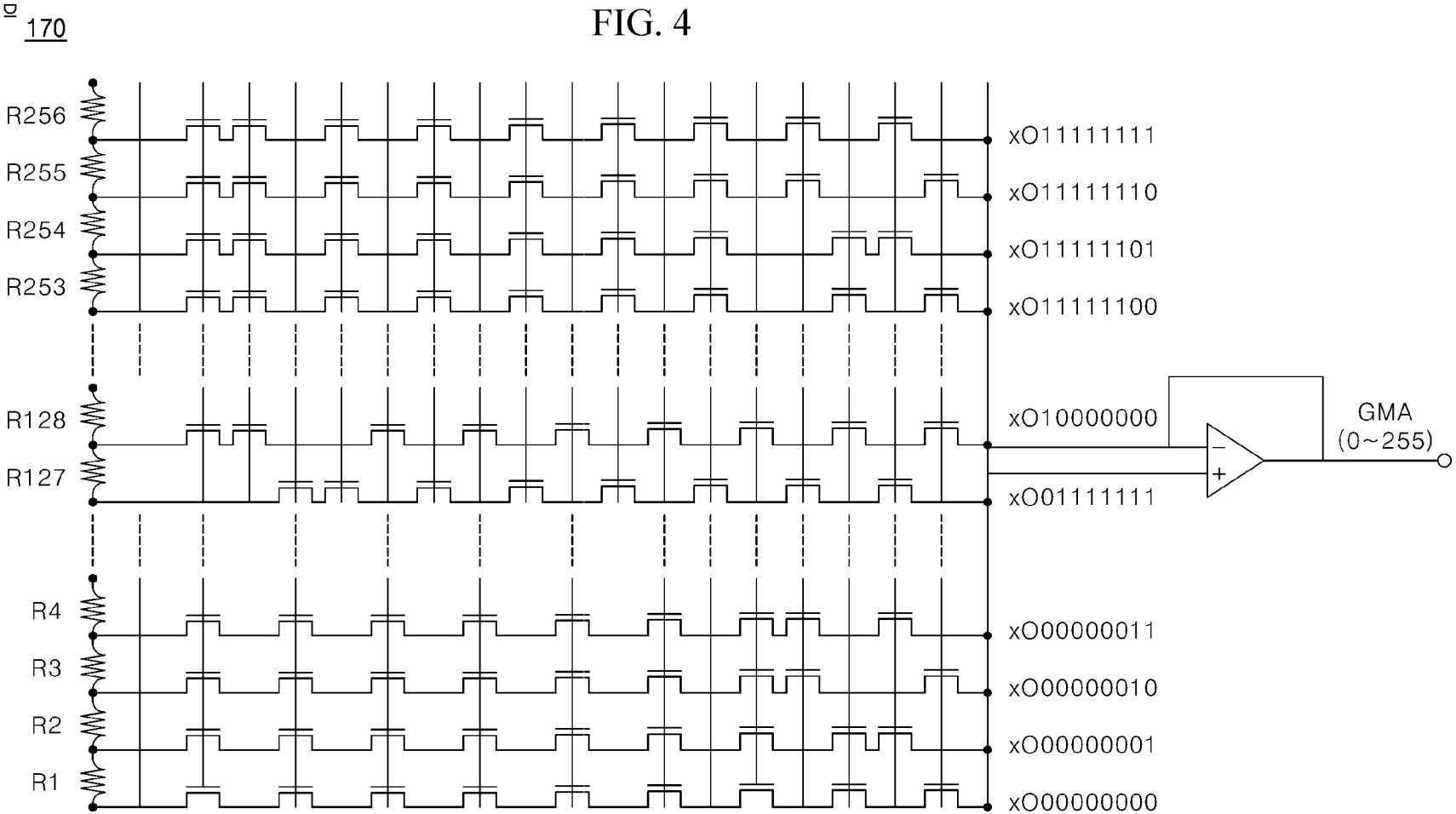
FIG. 4 is a conceptual diagram illustrating a display region divided into at least two block regions by a block divider shown in FIG. 3.
Figure 5:
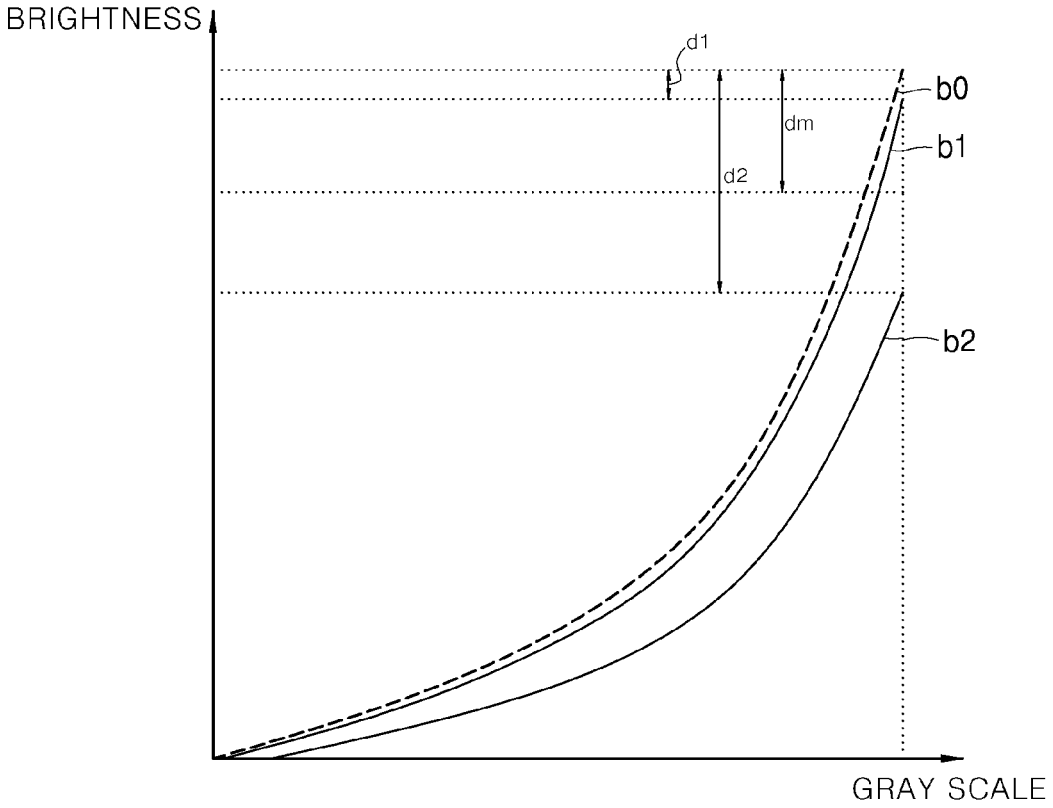
FIG. 5 is a conceptual diagram illustrating that brightness for each gray scale data of each of a first block region, a second block region, and a center block region is reduced.
Figure 6:
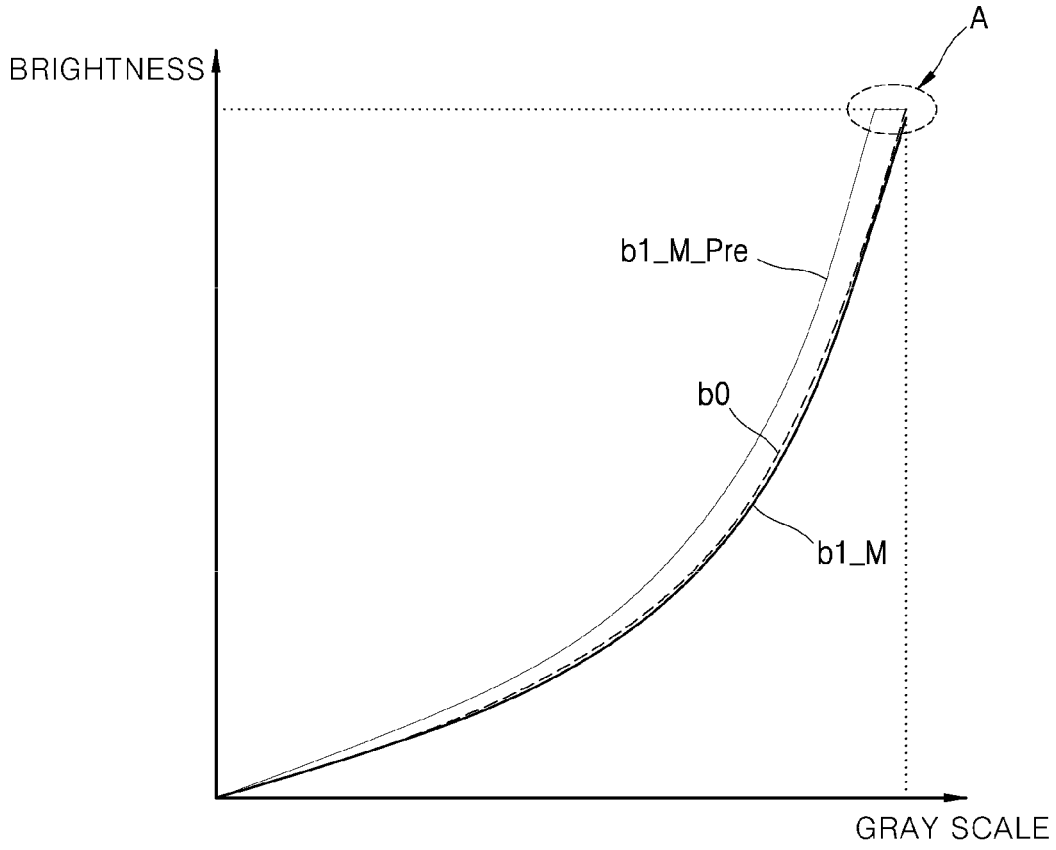
FIG. 6 is a conceptual diagram illustrating that brightness for each gray scale of a first block region of a general display device and brightness for each gray scale of a first block region of the first embodiment are exemplarily shown in FIG. 5.
Figure 7:
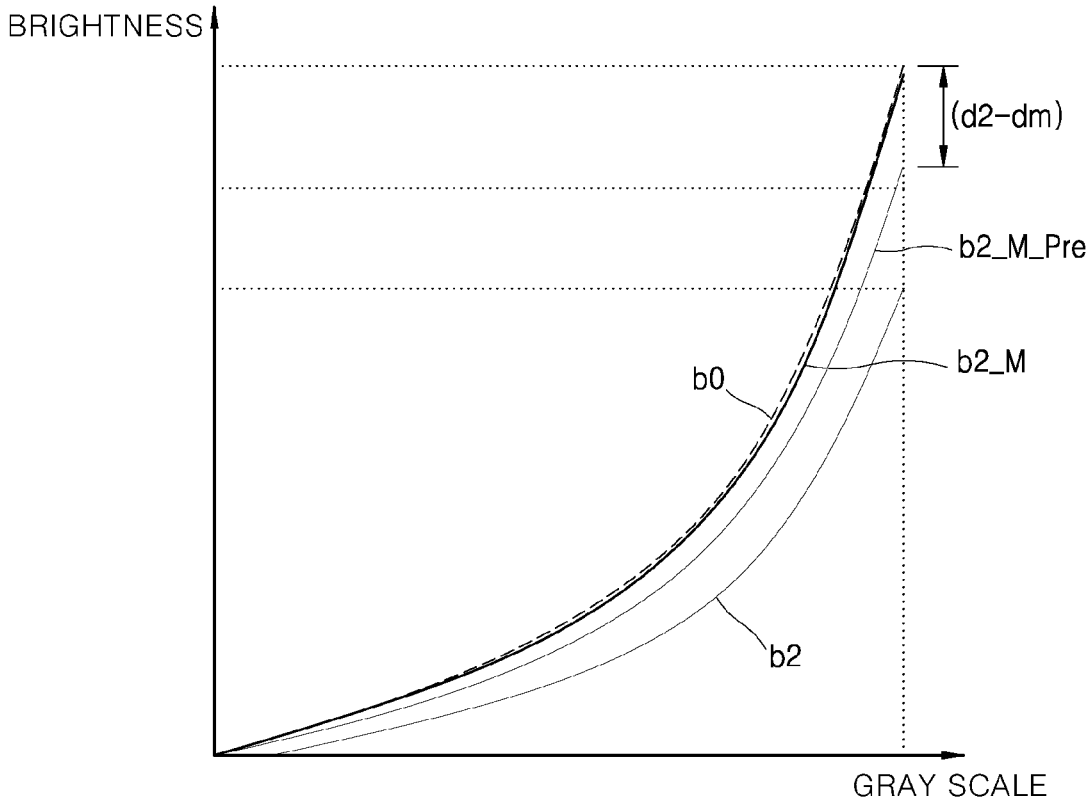
FIG. 7 is a conceptual diagram illustrating that brightness for each gray scale of a second block region of a general display device and brightness for each gray scale of a second block region of the first embodiment are exemplarily shown in FIG. 5.

FIG. 1 is a block diagram illustrating a display device according to a first embodiment of the present disclosure. FIG. 2 is a block diagram illustrating an image signal processor shown in FIG. 1. FIG. 3 is a plan view illustrating the display device shown in FIG. 1. FIG. 4 is a conceptual diagram illustrating a display region divided into at least two block regions by a block divider shown in FIG. 3. FIG. 5 is a conceptual diagram illustrating that brightness for each gray scale data of each of a first block region, a second block region, and a center block region is reduced. FIG. 6 is a conceptual diagram illustrating that brightness for each gray scale of a first block region of a general display device and brightness for each gray scale of a first block region of the first embodiment are exemplarily shown in FIG. 5. FIG. 7 is a conceptual diagram illustrating that brightness for each gray scale of a second block region of a general display device and brightness for each gray scale of a second block region of the first embodiment are exemplarily shown in FIG. 5.

Referring to FIG. 1, a display device 100 according to one embodiment of the present disclosure may include a display panel 110 including a gate line (GL), a data line (DL), and a plurality of pixel regions; a gate driver 120 providing the gate line (GL) with a gate signal; a data driver 130 providing the data line (DL) with a data signal; an image signal processor 140 generating modulation data (M_RGB) of each pixel region (PA) corresponding to each frame display period based on an image signal (IS) and predetermined modulation value tables; a timing controller 150 controlling driving of each of the gate driver 120 and the data driver 130 on the basis of the modulation data (M_RGB); a power-supply controller 160 providing the data driver 120 and the data driver 130 with drive voltage; and a reference gamma voltage supply unit 170 generating a plurality of reference gamma voltages GMA(0~255) by dividing the drive voltage supplied from the power-supply controller 160.

Although not shown in FIG. 1, the display panel 110 may include one pair of substrates (not shown) bonded to each other while facing each other; and a polarization or luminous material disposed between the one pair of substrates.

The display panel 110 may include a gate line (GL) of a first direction (X-axis direction); a data line (DL) of a second direction (Y-axis direction) perpendicular to the first direction (X-axis direction); and a plurality of pixel regions (PA) corresponding to a plurality of pixels. The plurality of pixel regions (PA) may be matrix-arranged in a display region for substantially displaying images, and may be defined as an intersection between the gate line (GL) and the data line (DL).

Each pixel region (PA) of the display panel 110 may include a thin film transistor (TFT) connected to the gate line (GL) and the data line (DL); and a pixel electrode (PE) and a storage capacitor (Cst) that are connected to a thin film transistor (TFT) and connected in parallel to each other.

In addition, when the display panel 110 includes a liquid crystal material disposed between one pair of substrates, the liquid crystal material affected by an electrical field generated between a common electrode (CE) connected to a common power-supply voltage ($V_{com}$) and a pixel electrode (PE) connected to the thin film transistor (TFT) may be defined as a liquid crystal capacitor ($C_{lc}$).

However, the above-mentioned embodiment is only disclosed for illustrative purposes, and is not shown in the drawings. The display panel 110 may include a drive thin film transistor (TFT) connected to a thin film transistor (TFT); and an OLED element emitting light corresponding to a drive current supplied through the drive TFT.

The gate driver 120 may sequentially provide a gate signal to gate lines (GL) included in the display panel 110 during a single vertical period for displaying individual frames.

The data driver 130 may provide the respective data signals to data lines (DL) included in the display panel 110 during a single horizontal period in which a gate signal is supplied to each gate line (GL). In this case, the data signal may correspond to brightness of each pixel region (PA) on the basis of the image signal (IS).

The image signal processor 140 may modulate gray scale data of each pixel region according to the overdriving scheme for improving a response speed of the operation for changing gray scale data of a previous frame into gray scale data of a current frame.

For example, if the display device 100 is a liquid crystal device including a liquid crystal material, a liquid crystal cell may answer an electric field at a low response speed due to unique viscosity and elasticity of the liquid crystal material, a poor image quality such as a motion blur may occur during a playback time of moving images. To address the above-mentioned issues, the display device 100 may include an image signal processor 140 modulating gray scale data of a current frame, such that the image signal processor 140 can compensate for reduction in response speed corresponding to a difference in gray scale between a previous frame and a current frame.

The image signal processor 140 according to a first embodiment of the present disclosure may generate modulation data of each pixel region (PA) based on a modulation value table which is selected from at least two modulation value tables being preset to different gains. The modulation value table is selected from at least two modulation value tables based on distances between each pixel region (PA) and either the gate driver 120 or the data driver 130. As a result, a difference in the charge amount according to line resistances of different pixel regions (PA) of individual positions can be compensated for, such that image quality deterioration caused by line resistance can be prevented.

That is, the image signal processor 140 may generate modulation data (M_RGB) of each pixel region (PA) based on not only a modulation value table that is preset to a predetermined gain corresponding to line resistance, but also the image signal (IS). A detailed description of the image signal processor 140 will hereinafter be described with reference to FIG. 2.

The timing controller 150 may output modulation data (M_RGB) received from the image signal processor 140 to the data driver 130.

The timing controller 150 may generate timing control signals for driving the gate driver 120 and the data driver 130 on the basis of timing signals DE and CLK received from the external system.

For example, the timing control signal for controlling the gate driver 120 after being received from the timing controller 150 may include a gate start pulse (GSP), a gate shift clock (GSC), and a gate output enable signal (GOE). The gate start pulse (GSP) may correspond to a specific time at which a first gate signal occurs. The gate shift clock (GSC) may be a clock signal for shifting the gate start pulse (GSP). The gate output enable signal (GOE) may be used to control the output of the gate driver 120.

In addition, the timing control signal for controlling the data driver 130 after being received from the timing controller 150 may include a source sampling clock (SSC), a polarity control signal (POL), and a source output enable signal (SOE). The source sampling clock (SSC) may control a data sampling operation and a latch operation of the data driver 130 on the basis of a rising edge or a falling edge. The polarity control signal (POL) may control polarity of the data signal generated by the data driver 130. The source output enable signal (SOE) may control an output time of the data driver 130.

The power-supply controller 160 may provide not only various power-supply voltages to drive the gate driver 120, but also various power-supply voltages to drive the data driver 130.

The reference gamma voltage supply unit 170 may perform division of the drive voltage received from the power-supply controller 160, thereby generating a plurality of reference gamma voltages GMA(0~255). In this case, the plurality of reference gamma voltages GMA(0~255) may correspond to gray scales (0~255 gray scales) of a predetermined range to be displayed in each pixel region (PA). That is, the reference gamma voltage supply unit 170 may provide a reference gamma voltage GMA(0~255) (i.e., a reference gamma voltage (GMA) corresponding to respective gray scale values) for displaying brightness corresponding to the respective gray scale values on the basis of a graph of brightness for each gray scale (i.e., a non-linear gamma curve).

Referring to FIG. 2, the image signal processor 140 according to the first embodiment may include a frame data generator 141, a block divider 142, at least two data modulators (1431, 1432, 1433) (hereinafter referred to as '143'), and a data output unit 144.

The frame data generator 141 may generate gray scale data (RGB) of the plurality of pixel regions (PA) corresponding to a display period of each frame based on the image signal (IS).

The block divider 142 may divide a display region of the display panel 110 into at least two block regions along a second direction (Y-axis direction), and may sort gray scale data (RGB) of the plurality of pixel regions (PA) such that the gray scale data (RGB) corresponding to each of the at least two block regions (B1, B2, . . . , Bn). A block region of the first embodiment will hereinafter be described with reference to FIG. 3.

Referring to FIG. 3, a display panel 110 of the display device 100 may include a display region (AA) for substantially displaying images thereon; and a non-display region (NA) defined as an outer wall of the display region (AA).

In addition, the gate driver 120 may be embedded in the display panel 110 for simplicity of assembly. The data driver 130 may include a source circuit substrate 131 on which various integrated circuits (ICs), passive elements, etc. are populated; a film 132 configured to interconnect the source circuit substrate 131 and the display panel 110; and a data drive integrated circuit (IC) 133 populated into the film 132. Although not shown in the drawings, the reference gamma voltage supply unit 170 may be arranged on the source circuit substrate 131.

In addition, the timing controller 150 and the power-supply controller 160 may be populated into a main circuit substrate 152 connected to the source circuit substrate 131 through the film 151 such as a TCP. In addition, the image signal processor 140 may be embedded in the timing controller 150, or may be implemented as a separate IC arranged on the main circuit substrate 152.

The display region (AA) of the display panel 110 may be divided into the at least two block regions (B1, B2, . . . , Bn) along the second direction (Y-axis direction) of the block divider (see 142 of FIG. 2). Since the data driver 130 is connected to one edge (i.e., an upper edge of FIG. 3) of the display panel 110, the at least two block regions (B1, B2, . . . , Bn) may be spaced apart from the data driver 130 by different distances.

That is, referring to FIG. 3, whereas the first block region B1 is located closest to the data driver 130, the second block region B2 may be located farther from the data driver 130 than the first block region B1.

Line resistance of the data line (DL) may correspond to the distance from the data driver 130, such that line resistance of the data line (DL) of the first block region B1 is less than that of the data line (DL) of the second block region B2. Accordingly, when the modulation data for overdriving is generated, the image signal processor 140 according to the first embodiment may use the predetermined modulation value tables by applying different gains to the respective block regions in a manner that a difference in line resistance can be applied to the respective block regions.

In more detail, as shown in FIG. 2, the image signal processor 140 of the display device 100 according to the first embodiment may include at least two data modulators 143 generating modulation data (B1_M_RGB, B2_M_RGB, . . . , Bn_M_RGB) for overdriving by applying the modulation value tables having different gains to gray scale data of the respective pixel regions (PA) of the different block regions (B1, B2, . . . , Bn).

Each of the at least two data modulators 143 may modulate gray scale data of each pixel region of each block region (B1, B2, . . . , Bn) according to the predetermined modulation value tables such that the respective data modulators can correspond to different gains.

For example, the at least two data modulators 143 may include a first data modulator 1431 corresponding to the first block region B1; and a second data modulator 1432 corresponding to the second block region B2 located farther from the data driver 130 than the first block region B1.

The first data modulator 1431 may generate modulation data (B1_M_RGB) of each pixel region included in the first block region B1 based on a first modulation value table that is preset to a first gain which is corresponding to line resistance of the first block region B1.

The second data modulator 1432 may generate modulation data (B2_M_RGB) of each pixel region included in the second block region B2 on the basis of a second modulation value table that is preset to a second gain higher than the first gain. Therefore, the second data modulator 1432 can correspond to line resistance of the second block region B2 instead of line resistance of the first block region B1.

Table 1 illustrates one example of a modulation value table.

TABLE 1

| | P | | | | | | | | |
|---|---|---|---|---|---|---|---|---|---|
| C | 0 | 32 | 64 | 96 | 128 | 160 | 192 | 224 | 255 |
| 0 | 0 | 0 | 0 | 0 | 0 | 0 | 0 | 0 | 0 |
| 32 | 35 | 32 | 31 | 30 | 29 | 28 | 27 | 26 | 18 |
| 64 | 70 | 66 | 64 | 62 | 61 | 60 | 59 | 57 | 46 |
| 96 | 105 | 100 | 98 | 96 | 95 | 94 | 92 | 89 | 78 |
| 128 | 138 | 134 | 132 | 130 | 128 | 126 | 125 | 122 | 113 |
| 160 | 173 | 167 | 165 | 163 | 162 | 160 | 158 | 156 | 149 |
| 192 | 204 | 201 | 199 | 197 | 195 | 194 | 192 | 190 | 184 |
| 224 | 233 | 231 | 230 | 229 | 228 | 227 | 226 | 224 | 221 |
| 255 | 255 | 255 | 255 | 255 | 255 | 255 | 255 | 255 | 255 |

Referring to Table 1, the modulation value table may include modulation values corresponding to two or more representative gray scale values (0, 32, 64, 96, 128, 160, 192, 224, 255) of the previous frame (P: a horizontal axis of Table 1), two or more representative gray scale values (0, 32, 64, 96, 128, 160, 192, 224, 255) of the current frame (C: a vertical axis of Table 1) and the gain of each block region (B1, B2, . . . , Bn) in which the pixel region is included. The representative gray scale values (0, 32, 64, 96, 128, 160, 192, 224, 255) of the previous frame (P: a horizontal axis of Table 1) are selected from among gray scale values of a predetermined range corresponding to the modulation data of the previous frame. The representative gray scale values (0, 32, 64, 96, 128, 160, 192, 224, 255) of the current frame (C: a vertical axis of Table 1) are selected from among gray scale values of a predetermined range corresponding to the gray scale data of the current frame.

In this case, the predetermined range of the gray scale value may include 256(=$2^8$) gray levels ranging from 0 to 255 on the basis of 8 bits.

In addition, two or more representative gray scale values may include a minimum gray scale value (0) and a maximum gray scale value (255) from among gray scale values (0~255) of the predetermined range. Alternatively, as shown in Table 1, at least two representative gray scale values may be comprised of gray scale values enumerated at the same interval (32).

According to the modulation value table shown in Table 1, if gray scale data (C) of the current frame is smaller than modulation data (P) of the previous frame, modulation data having a modulation value higher than gray scale data (C) of the current frame may be generated on the basis of gains of the respective block regions (B1, B2, . . . , Bn). For example, when modulation data of the previous frame (P) is set to 128 and gray scale data of the current frame (C) is set to 64, the gray scale data is modulated into modulation data of 61 lower than 64. As a result, the overdriving scheme for compensating for a low response speed can be applied to the display device of the present disclosure.

Alternatively, according to the modulation value table of Table 1, if gray scale data (C) of the current frame is larger than modulation data (P) of the previous frame, modulation data having a modulation value lower than gray scale data (C) of the current frame may be generated on the basis of gains of the respective block regions (B1, B2, . . . , Bn). For example, when modulation data of the previous frame (P) is set to 32 and gray scale data of the current frame (C) is set to 192, the gray scale data is modulated into modulation data of 201 higher than 192, resulting in reduction in power consumption.

If modulation data (P) of the previous frame or gray scale data (C) of the current frame is not matched to a representative gray scale value, each data modulator 143 may generate modulation data using a modulation value derived from a contiguous representative gray scale value.

For example, referring to the modulation value table of Table 1, when modulation data (P) of the previous frame is set to 98 and gray scale data (C) of the current frame is set to 32, the modulation data may be calculated as 30(←30−1/32) that is derived from a modulation value when the modulation data (P) of the previous frame is 96. Alternatively, when modulation data (P) of the previous frame is 160 and gray scale data (C) of the current frame is 194, the modulation data may be derived from modulation values (194, 227) when the gray scale data (C) of the current frame is 192~224, such that the resultant modulation data can be calculated as 196(←194+(196−194)*(227−194)/32).

Each data modulator 143 may include a table storage unit 201, a previous data storage unit 202, and a modulation processor 203. The table storage unit 201 may provide a modulation value table that is preset to a gain corresponding to each block region (B1, B2, . . . , Bn). The previous data storage unit 202 may provide modulation data of the previous frame. The modulation processor 203 may generate modulation data of each pixel region included in each block region (B1, B2, . . . , Bn) by modulating gray scale data of each pixel region included in each block region (B1, B2, . . . , Bn) corresponding to the current frame based on the modulation value table and modulation data of the previous frame.

Although not shown in the drawings, the modulation value table to which a gain higher than in the modulation value table of Table 1 is applied may include a modulation value having a higher gain obtained from a specific point at which there is a large difference between modulation data of the previous frame and gray scale data of the current frame.

The data output unit 144 may collect modulation data generated from the at least two data modulators 143, such that the data output unit 144 may output modulation data (M_RGB) of each of the plurality of pixel regions corresponding to a display period of each frame to the timing controller 150.

Meanwhile, the reference gamma voltage generator 170 may perform division of the drive voltage received from the power-supply controller 160, thereby generating a plurality of reference gamma voltages GMA(0~255) corresponding to gray scale values of the predetermined range.

For example, as shown in FIG. 4, when the gray scale value of the predetermined range is 0~255, the reference gamma voltage generator 170 may divide the drive voltage into 255 voltages, thereby generating 255 reference gamma voltages GMA(0~255) corresponding to gray scale values of 1~255. In this case, the data driver 130 may output a data signal having a voltage level for representing each brightness corresponding to each gray scale value to the data line (DL) on the basis of the plurality of reference gamma voltages GMA(0~255).

As described above, according to the first embodiment of the present disclosure, gray scale data for overdriving may be modulated using the predetermined modulation value table that is preset to different gains corresponding to the respective block regions (B1, B2, . . . , Bn), thereby compensating for line resistances corresponding to the respective block regions (B1, B2, . . . , Bn). As a result, the difference in the charge amount caused by line resistance can be compensated such that the image quality deterioration caused by line resistance can be prevented.

That is, as shown in FIG. 5, due to line resistance proportional to the distance from the data driver 130, the brightness graph (b1) for each gray scale of the first block region (B1) may be less than the output signal (b0) of the data driver 130 by a first difference (d1). The brightness graph (b2) for each gray scale of the second block region (B2) located farther from the data driver 130 than the first block region (B1) may be less than the output signal (b0) of the data driver 130 by a second difference (d2) that is larger than the first difference (d1).

In this case, when gray scale data of each pixel region of the first block region (B1) is modulated using the modulation value table in which a gain corresponding to an average value (dm) of the first and second differences (d1, d2) is reflected, the brightness graph (b1_M_pre) for each gray scale after completion of the modulation corresponding to the first block region (B1) may encounter a lump of gray scales in a high gray scale region due to occurrence of overcompensated modulation data as shown in FIG. 6A.

If gray scale data of each pixel region of the second block region (B2) is modulated using the modulation value table in which a gain corresponding to the average value (dm) of the first and second differences (d1, d2), the brightness graph (b2_M_pre) (see a thin solid line of FIG. 7) for each gray scale after completion of modulation corresponding to the second block region (B2) may be lower than the gray scale graph (b0) for each brightness of the output signal of the data driver 130 by a difference between the second difference (d1) and the average value (dm). As a result, weak charging caused by insufficient compensation may be occurred at all gray scale values.

However, according to the first embodiment, a relatively low gain is applied to the first block region (B1) having a relatively low line resistance, such that gray scale data may be modulated according to a predetermined gray scale value table. As a result, the brightness graph (b1_M) (see a bold solid line of FIG. 6) for each gray scale corresponding to the first block region (B1) may be similar to the gray scale graph (b0) for each brightness of the output signal of the data driver 130 such that occurrence of a lump of gray scales can be prevented in a high gray scale region.

In addition, a relatively high gain is applied to the second block region (B2) having a relatively high value such that gray scale data is modulated according to the predetermined modulation value table. As a result, the brightness graph (b2_M) (see a bold solid line of FIG. 7) for each gray scale corresponding to the second block region (B2) may be similar to the gray scale graph (b0) for each brightness of the output signal of the data driver 130 such that occurrence of weak charging can be prevented.

As described above, according to the first embodiment of the present disclosure, overdriving is carried out using a gain based on line resistance. As a result, the charge amount difference caused by line resistance can be compensated such that image quality deterioration caused by a difference in the charge amount can be prevented. Therefore, the first embodiment can be properly applied to high-definition and large-sized display devices, and can also be easily applied to a structure for reducing an integrated circuit (IC) of the data driver.

Meanwhile, the N-th data modulator 1433 corresponding to the N-th block region located farthest from the data driver 130 may modulate gray scale data of each pixel region of the N-th block region on the basis of the N-th modulation value table that is preset to the N-th gain. In this case, if the N-th gain corresponding to the N-th block region is reflected in a gray scale value having relatively high gray scale data, the N-th gain can be calculated as a value higher than the maximum gray scale value 255 from among gray scale values of the predetermined range.

However, as described above, the reference gamma voltage supply unit 170 may provide only the reference gamma voltages GMA(0~255) corresponding to gray scale values of the predetermined range. As a result, a reference gamma voltage corresponding to a gray scale value higher than the maximum gray scale value 255 cannot be applied to the data driver 130, such that gray scale data having a maximum gray scale value arranged in the N-th block region cannot be compensated by the N-th gain based on line resistance.

The second embodiment for addressing the above-mentioned issues will hereinafter be given.

Figure 8:
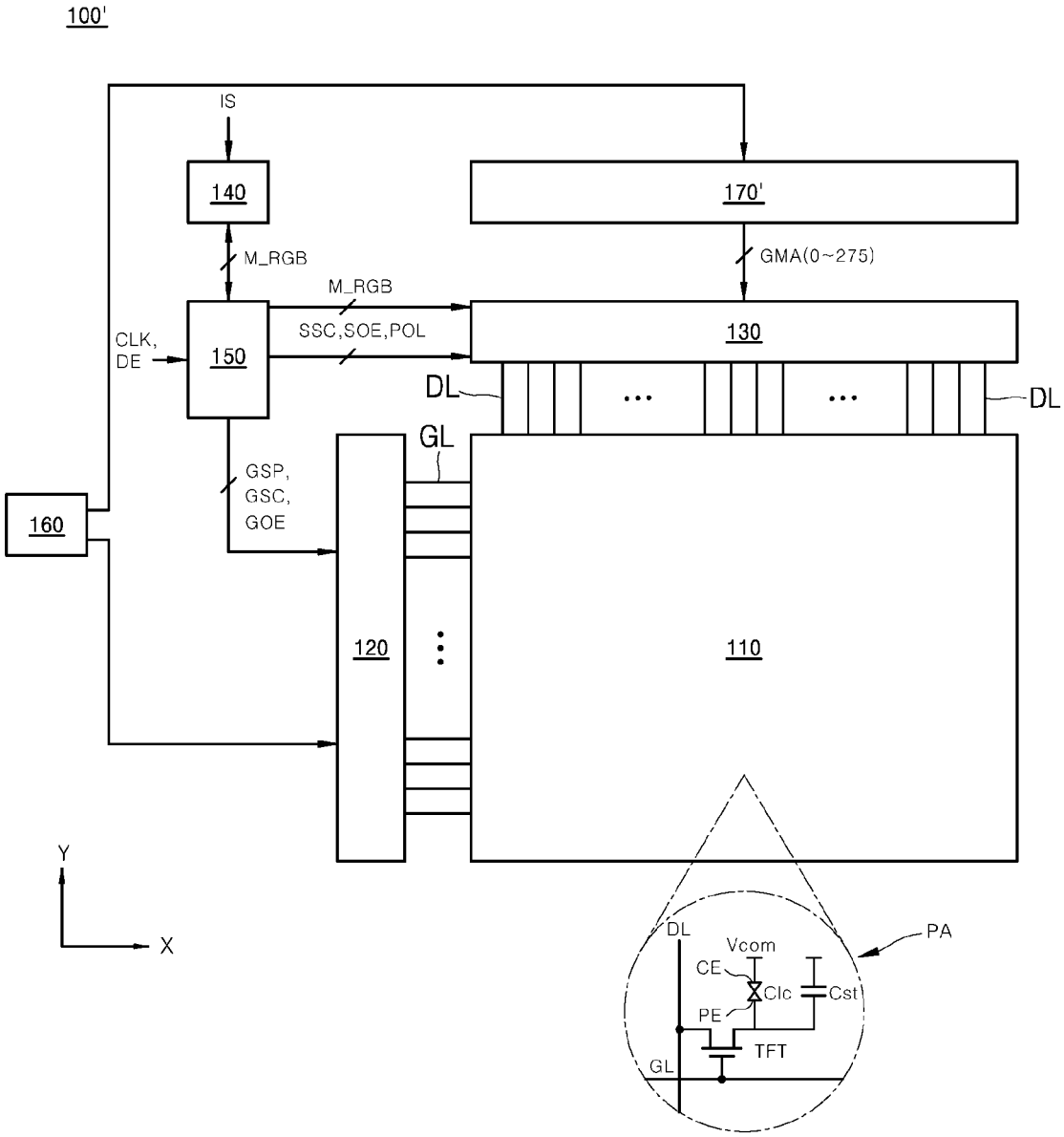
FIG. 8 is a block diagram illustrating a display device according to a second embodiment of the present disclosure.

FIG. 8 is a block diagram illustrating a display device according to a second embodiment of the present disclosure.

Referring to FIG. 8, the display device according to the second embodiment may allow the N-th modulation value table preset to the N-th gain corresponding to the N-th block region to include a modulation value higher than a maximum gray scale value from among gray scale values of the predetermined range. For this purpose, the remaining parts of the second embodiment other than characteristics in which the reference gamma voltage supply unit 170' provides a reference gamma voltage GMA(0~275) corresponding to a modulation value higher than the maximum gray scale value are identical to those of the first embodiment shown in FIGS. 1 to 7, and as such a detailed description thereof will herein be omitted for convenience of description.

Table 2 illustrates one example of the N-th modulation value table.

TABLE 2

| | P | | | | | | | | |
|---|---|---|---|---|---|---|---|---|---|
| C | 0 | 32 | 64 | 96 | 128 | 160 | 192 | 224 | 255 |
| 0 | 0 | 0 | 0 | 0 | 0 | 0 | 0 | 0 | 0 |
| 32 | 35 | 32 | 31 | 30 | 29 | 28 | 27 | 26 | 18 |
| 64 | 70 | 66 | 64 | 62 | 61 | 60 | 59 | 57 | 46 |
| 96 | 105 | 100 | 98 | 96 | 95 | 94 | 92 | 89 | 78 |
| 128 | 138 | 134 | 132 | 130 | 128 | 126 | 125 | 122 | 113 |
| 160 | 173 | 167 | 165 | 163 | 162 | 160 | 158 | 156 | 149 |
| 192 | 204 | 201 | 199 | 197 | 195 | 194 | 192 | 190 | 184 |
| 224 | 260 | 231 | 230 | 229 | 228 | 227 | 226 | 224 | 221 |
| 255 | 275 | 273 | 270 | 267 | 265 | 262 | 260 | 258 | 255 |

As shown by the (C=224, P=0) and (C=255, P=0 to 224) entries of Table 2, the N-th modulation value table according to the second embodiment may include modulation values higher than the maximum gray scale value 255. For example, the modulation value higher than the maximum gray scale value 255 may correspond to one case in which modulation data (P) of the previous frame is less than 255 and gray scale data (C) of the current frame is a maximum gray scale value 255, and may also correspond to the other case in which a variation width between the modulation data (P) of the previous frame and the gray scale data (C) of the current frame is equal to or higher than 225 (0→224).

The reference gamma voltage generator 170' according to the second embodiment may generate a plurality of reference gamma voltages ranging from gray scale values of the predetermined range to the modulation values higher than a maximum gray scale value.

In more detail, the output voltage from the reference gamma voltage supply unit 170' according to the second embodiment may be divided into many more sub-voltages than those of the first embodiment such that a reference gamma voltage corresponding to a modulation value higher than the maximum gray scale value can be supplied.

For example, as shown in Table 2, when the modulation value ranges from 0 to 275, the reference gamma voltage supply unit may divide a drive voltage into 276 voltages (0 gray scale value to 275 gray scale value), such that a reference gamma voltage corresponding to 0 to 275 gray scale values can be supplied.

As described above, the second embodiment includes the modulation values higher than the maximum gray scale value, and overdriving can also be applied to the high gray scale value, such that insufficient compensation of the high gray scale value can be prevented. Accordingly, line resistance and a response speed can also be compensated in a high gray scale range, resulting in improved image quality.

Meanwhile, although the first and second embodiments disclose a method for compensating for line resistance of the data line (DL) that relatively and highly affects the image quality, it should be noted that the gate line (GL) includes unique line resistance.

A third embodiment of the present disclosure relates to a display device for compensating for line resistance of the gate line.

Figure 9:
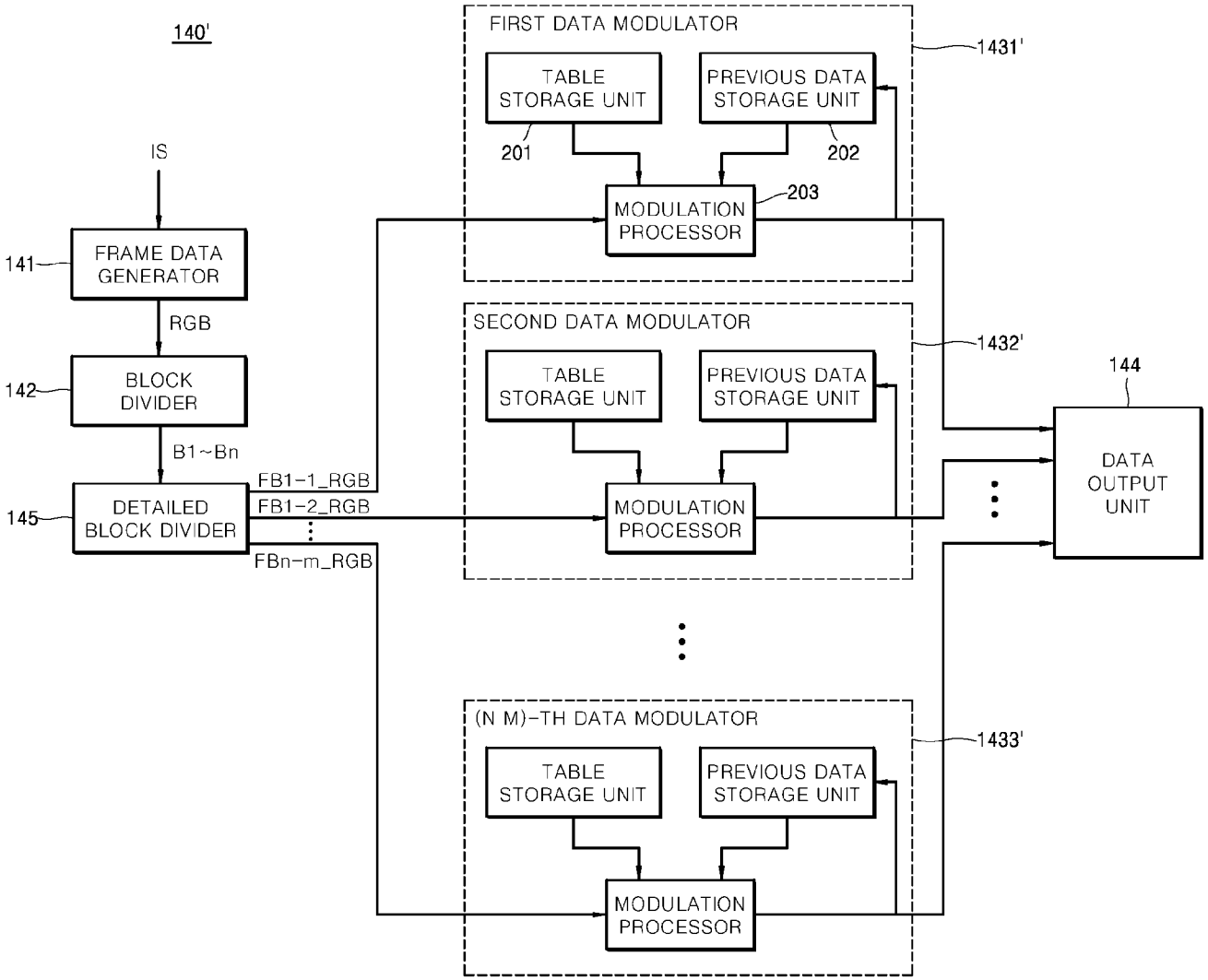
FIG. 9 is a block diagram illustrating an image signal processor shown in FIG. 1 according to a third embodiment of the present disclosure.
Figure 10:
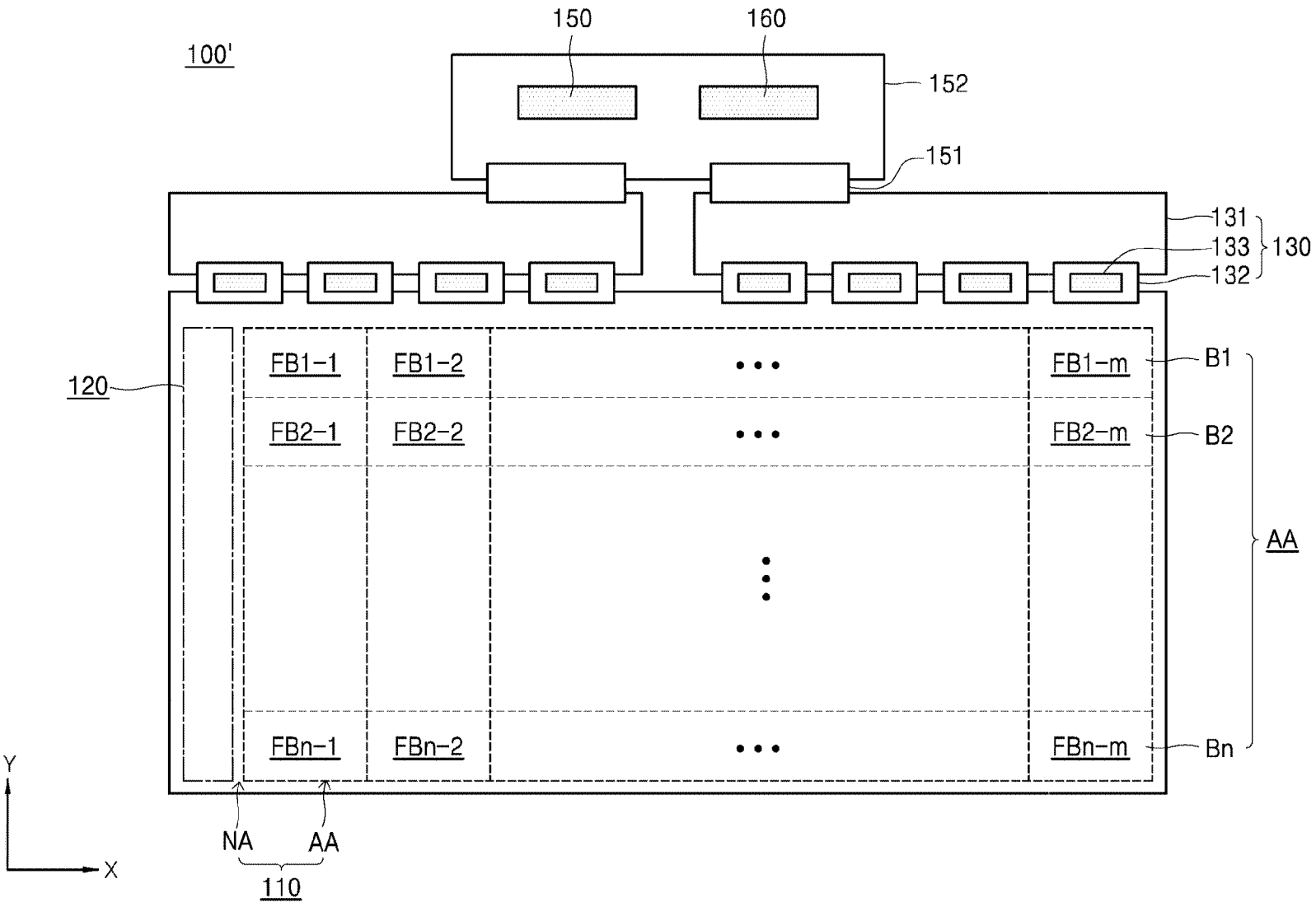
FIG. 10 is a conceptual diagram illustrating each block region divided into at least two detailed regions by a detailed block divider of FIG. 9.

FIG. 9 is a block diagram illustrating the image signal processor shown in FIG. 1 according to a third embodiment of the present disclosure. FIG. 10 is a conceptual diagram illustrating each block region divided into at least two detailed regions by the detailed block divider of FIG. 9.

Referring to FIG. 9, the display device according to the third embodiment may allow the image signal processor 140' to include a detailed block divider 145, and each data modulator 143 corresponds to each detailed block region, differently from the first and second embodiments of the present disclosure. The remaining parts of the third embodiment other than the above-mentioned characteristics are identical to those of the first and second embodiments of FIGS. 1 to 8, and as such a detailed description thereof will herein be omitted for convenience of description.

Referring to FIG. 9, the image signal processor 140' according to the third embodiment may further include a detailed block divider 145. The detailed block divider 145 may divide each of the at least two block regions into the at least two detailed block regions along the first direction (X-axis direction of FIG. 10) by the block divider 142, and may divide gray scale data of pixel regions included in each block region into regions corresponding to the at least two detailed block regions.

The detailed block divider 145 may provide gray scale data of pixel regions included in each detailed block region (FB1-1, . . . , FBn-m) to each of the at least two data modulators 143.

For example, as shown in FIG. 10, the display region (AA) of the display panel 110 may be divided into at least two block regions (B1, B2, . . . , Bn) along the second direction (Y-axis direction) by the block divider 142.

Each block region (B1, B2, . . . , Bn) may be divided into the at least two detailed block regions (FB1-1, FB1-2, . . . , FB**1-*m*)(FB2-1, FB2-2, . . . , FB2-*m*)(FBn-1, FBn-2, . . . , FBn-m) along the first direction (X-axis direction) by the detailed block divider 145**.

If the gate driver 120 is embedded in one edge of the display panel 110, the at least two detailed block regions (FB1-1, FB1-2, . . . , FB**1-*m*)(FB2-1, FB2-2, . . . , FB2-*m*)(FBn-1, FBn-2, . . . , FBn-m) corresponding to each block region (B1, B2, . . . , Bn) may be spaced apart from the gate driver 120** by different distances.

That is, whereas the first detailed block region (FB1-1) of the first block region (B1) is located closest to the gate driver 120, the second detailed block region (FB1-2) may be located farther from the gate driver 120 than the first detailed block region.

Line resistance of the gate line (GL) corresponds to the distance from the gate driver 120, such that line resistance of the gate line of the first detailed block region (FB**1-*m*) may be less than the second detailed block region (FB1-2). Accordingly, each of at least two data modulators 143 according to the third embodiment may correspond to each detailed block region (FB1-1, FB1-2, . . . , FB1-*m*)(FB2-1, FB2-2, . . . , FB2-*m*)(FBn-1, FBn-2**, . . . , FBn-m), and different detailed gains are applied to the respective detailed block regions of each block region, such that modulation data for overdriving may be generated using the predetermined modulation value table.

For example, as shown in FIG. 9, the at least two data modulators 143 may include first and second data modulators (1431', 1432') corresponding to the first and second detailed block regions (FB1, FB2) formed by division of the first block region (B1). In this case, the first detailed block region (FB1-1) may be located closer to the gate driver 120 as compared to the second detailed block region (FB1-2).

In this case, the first data modulator 1431' may modulate gray scale data of pixel regions included in the first detailed block region (FB1-1) based on the first modulation value table that is preset to the first detailed gain, thereby generating modulation data (FB1-1_M) of the pixel regions included in the first detailed block region (FB1-1).

The second data modulator 1432' may modulate gray scale data of pixel regions included in the second detailed block region (FB1-2) based on a second modulation value table that is preset to a second detailed gain that is higher than the first detailed gain.

In addition, the detailed gain corresponding to the first (1−1)-th detailed block region (FB1-1) of the first block region (B1) may be lower than a detailed gain corresponding to the (N−1)-th detailed block region (FBn-1) of the N-th block region (Bn) located farthest from the data driver 130.

In addition, the detailed gain corresponding to the (1−m)-th detailed block region (FB**1-*m*) of the first block region (B1) may be equal to or less than a detailed gain corresponding to the (N−1)-th detailed block region (FBn-1**) of the N-th block region (Bn).

As described above, according to the third embodiment of the present disclosure, the gain for overdriving may be established in different ways according to the distances from the gate driver 120, such that line resistance of the gate line (GL) can be compensated, resulting in reduction in image quality.

As is apparent from the above description, a display region is divided into the at least two block regions along an arrangement direction of a data line. To compensate for different line resistances because the respective block regions are spaced apart from the data driver by different distances, gray scale data of each pixel region may be modulated using a predetermined modulation value table according to different gains designated according to respective block regions. Therefore, through overdriving, wherein different gains for the respective block regions are applied, a difference in the charge amount caused by different line resistances for individual block regions can be compensated for, such that image quality deterioration caused by line resistance can be prevented from occurring.

In addition, since the image quality deterioration caused by line resistance can be prevented, the display device according to the present disclosure can be highly beneficial to implementation of larger-sized and higher-definition products, such that the display device can be beneficially applied to a DRD or TRD structure for reducing the number of data lines.

Further, in accordance with example embodiments, an image signal processor may modulate gray scale data of each pixel region according to the overdriving scheme so as to compensate for a response speed delay or the like, and may modulate gray scale data of each pixel region based on modulation value tables being preset by different gains of the respective block regions. Therefore, a difference in the charge amount caused by line resistance can be compensated through overdriving.

It will be apparent to those skilled in the art that various modifications and variations can be made in the display device of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a display panel including:

a gate line of a first direction;

a data line of a second direction perpendicular to the first direction; and a plurality of pixel regions corresponding to a plurality of pixels;

a gate driver configured to provide a gate signal to the gate line;

a data driver configured to provide a data signal to the data line;

an image signal processor generating modulation data of each pixel region corresponding to a display period of each frame based on an image signal and predetermined modulation value tables; and a timing controller configured to control driving of each of the gate driver and the data driver based on modulation data of each pixel region, wherein the image signal processor includes:

a frame data generator configured to generate gray scale data of each pixel region corresponding to a display period of each frame based on the image signal;

a block divider configured to:

divide the display region into at least two block regions along the second direction; and sort gray scale data of the plurality of pixel regions such that the gray scale data corresponding to each of the at least two block regions is deducted;

at least two data modulators corresponding to the at least two block regions, each of the at least two data modulators configured to modulate gray scale data of each of the pixel regions included in each block region based on the predetermined modulation value table to generate modulation data of each of the pixel regions included in each block region, the predetermined modulation value tables of the at least two data modulators being preset to different gains, each of the modulation value tables providing a correspondence between each of a plurality of representative grayscale values of a previous frame to each of a respective plurality of representative grayscale values of a current frame, the representative grayscale values being selected at a granularity greater than 1 grayscale value among a predetermined range of gray scale values; and a data output unit configured to:

collect modulation data generated from the at least two data modulators; and provide modulation data of each pixel region corresponding to a display period of each frame to the timing controller.

2. The display device according to claim 1, wherein the at least two data modulators include:

a first data modulator corresponding to a first block region adjacent to the data driver from among the at least two block regions, the first data modulator being configured to generate modulation data of each of the pixel regions included in the first block region based on a first modulation value table that is preset according to a first gain; and a second data modulator corresponding to a second block region located farther from the data driver from among the at least two block regions than the first block region, the second data modulator being configured to generate modulation data of each of pixel regions included in the second block region based on a second modulation value table that is preset according to a second gain higher than the first gain.

3. The display device according to claim 1, wherein:

each of the modulation value tables of the at least two data modulators includes modulation values corresponding to two or more representative gray scale values of a previous frame, two or more representative gray scale values of a current frame, and a gain of each block region; and the two or more representative gray scale values include at least a minimum gray scale value and a maximum gray scale value from among the predetermined range of the gray scale values.

4. The display device according to claim 3, wherein each data modulator includes:

a table storage unit configured to provide a modulation value table that is preset to a gain corresponding to each block region;

a previous data storage unit configured to provide modulation data of the previous frame; and a modulation processor configured to generate modulation data of each pixel region included in each block region by modulating gray scale data of each pixel region included in each block region corresponding to the current frame based on the modulation data of the previous frame and the modulation value table.

5. The display device according to claim 3, wherein:

the at least two data modulators include an $N^{th}$ data modulator corresponding to an $N^{th}$ block located farthest from the data driver from among the at least two blocks, the at least two data modulators being configured to generate modulation data of each pixel region included in the $N^{th}$ block based on an $N^{th}$ modulation value table that is preset to an $N^{th}$ gain; and the $N^{th}$ modulation value table includes a modulation value higher than the maximum gray scale value.

6. The display device according to claim 5, further comprising:

a power-supply controller configured to provide each of the gate driver and the data driver with a respective drive voltage; and a reference gamma voltage supply unit configured to divide the drive voltage supplied from the power-supply controller to generate a plurality of reference gamma voltages respectively corresponding to gray scale values of the predetermined range and a modulation value higher than the maximum gray scale value, wherein the data driver is further configured to generate a data signal corresponding to modulation data using the plurality of reference gamma voltages.

7. The display device according to claim 1, wherein:

the image signal processor further includes a detailed block divider dividing each of the at least two block regions into at least two detailed block regions along the first direction, the image signal processor being configured to sort gray scale data of pixel regions included in each block region such that the gray scale data corresponding to each of the at least two detailed block regions is deducted; and the at least two data modulators are configured to modulate gray scale data of each pixel region included in each of the at least two detailed block regions based on modulation value tables that are preset to different detailed gains.

8. The display device according to claim 7, wherein:

the at least two data modulators include first and second data modulators corresponding to first and second detailed block regions obtained by division of any one of the block regions;

the first detailed block region is located closer to the gate driver than the second detailed block region;

the first data modulator modulates gray scale data of pixel regions included in the first detailed block region based on a first modulation value table that is preset to a first detailed gain; and the second data modulator is configured to modulate gray scale data of pixel regions included in the second detailed block region based on a second modulation value table that is preset to a second detailed gain higher than the first detailed gain.

9. The display device according to claim 3, wherein the granularity is 32 grayscale values when the maximum gray scale value is 255.

* * * * *